US006573694B2

(12) United States Patent
Pulkin et al.

(10) Patent No.: US 6,573,694 B2
(45) Date of Patent: Jun. 3, 2003

(54) STABLE LOW DROPOUT, LOW IMPEDANCE DRIVER FOR LINEAR REGULATORS

(75) Inventors: Mark Pulkin, Rowlett, TX (US); Gabriel A. Rincon-Mora, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/170,310

(22) Filed: Jun. 13, 2002

(65) Prior Publication Data

US 2003/0001550 A1 Jan. 2, 2003

Related U.S. Application Data

(60) Provisional application No. 60/301,369, filed on Jun. 27, 2001.

(51) Int. Cl.[7] ..... G05F 1/40; G05F 1/44

(52) U.S. Cl. ..... 323/273; 323/274; 323/276; 323/277

(58) Field of Search ..... 323/273, 274, 323/275, 276, 277

(56) References Cited

U.S. PATENT DOCUMENTS 5,909,109 A * 6/1999 Phillips ..... 323/277
6,046,577 A * 4/2000 Rincon-Mora et al. ..... 323/282
6,188,211 B1 * 2/2001 Rincon-Mora et al. ..... 323/280
6,465,994 B1 * 10/2002 Xi ..... 323/274

* cited by examiner

*Primary Examiner*—Bao Q. Vu
(74) *Attorney, Agent, or Firm*—Alan K. Stewart; W. James Brady, III; Frederick J. Telecky, Jr.

(57) ABSTRACT

A voltage regulator circuit that provides the current necessary to drive an output driver during transients and maintain low output impedance, while having a much better dropout voltage than a single source follower gain stage includes: an output driver 22; a source follower 34 for controlling the output driver; a localized feedback gain loop coupled to the source follower 34; and an amplifier 24 for controlling the source follower 34.

14 Claims, 6 Drawing Sheets

STABLE LOW DROPOUT, LOW IMPEDANCE DRIVER FOR LINEAR REGULATORS

This application claims priority under 35 USC §119 (e) (1) of provisional application No. 60/301,369 filed Jun. 27, 2001

FIELD OF THE INVENTION

This invention generally relates to electronic systems and in particular it relates to voltage regulator circuits.

BACKGROUND OF THE INVENTION

Linear regulators that use NPN output drivers must be able to drive the base of the NPN transistor, which could mean potentially high current values. They must also be able to provide the displacement current needed to drive the load capacitance, as well as the parasitic capacitance, during transients. The typical prior art circuit used to drive an output NPN transistor is either an NPN emitter follower or NMOS source follower gain stage as shown in FIG. 1. The prior art circuit of FIG. 1 includes NMOS transistor 20; NPN output driver 22; amplifier 24; resistors 26 and 27; load capacitance CL; current IL; bias current Ibias; reference voltage Vref; supply voltage Vs; output voltage Vout; and ground gnd. This solution requires that the supply voltage Vs be at least a gate-to-source voltage (Vgs) (or a base-to-emitter voltage (Vbe) for an NPN common-emitter circuit) above the voltage at the base of the output NPN transistor 22 (which is a Vbe above the regulated output voltage Vout). This voltage could be quite large, especially if the required current is in the milliamp range.

In another potential solution to the problem, an amplifier could be designed to drive the base current and maintain the low impedance at the output; however, that solution would be more complex, requiring more area and potentially more quiescent current, and a high output current output stage.

SUMMARY OF THE INVENTION

A voltage regulator circuit that provides the current necessary to drive an output driver during transients and maintain low output impedance, while having a much better dropout voltage than a single source follower gain stage includes: an output driver; a source follower for controlling the output driver; a localized feedback gain loop coupled to the source follower; and an amplifier for controlling the source follower.

DETAILED DESCRIPTION OF PREFERRED EMBODIMENTS

Figure 1:
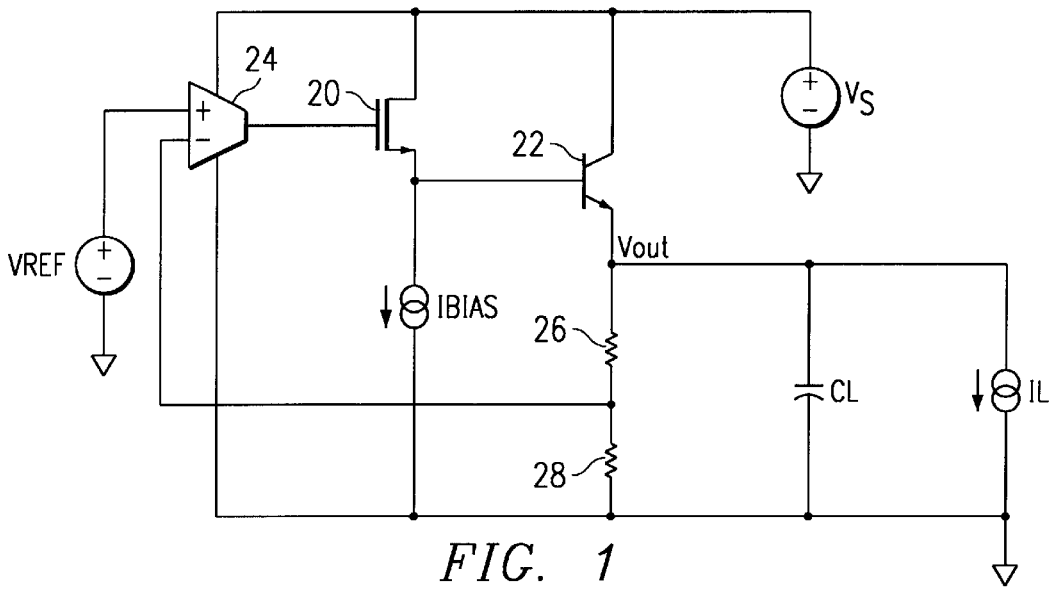
FIG. 1 (PRIOR ART)
FIG. 1 is a schematic circuit diagram of a prior art linear voltage regulator using an NPN output transistor.
Figure 2:
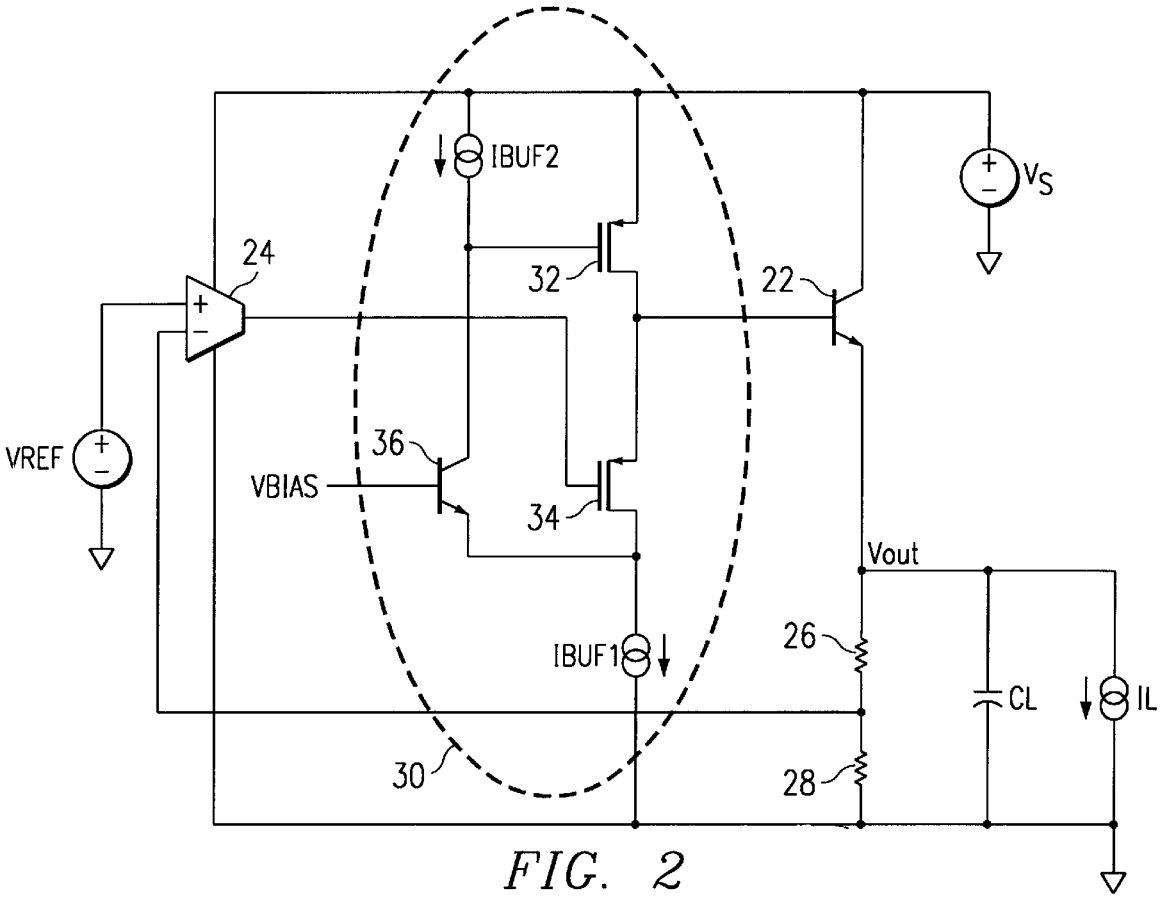
FIG. 2 is a schematic circuit diagram of a voltage regulator circuit with a preferred embodiment buffer for driving the output NPN transistor.

The preferred embodiment buffer, shown in FIG. 2, provides the current necessary to drive the NPN during transients and maintain low output impedance, while having a much better dropout voltage than a single source follower gain stage. The circuit of FIG. 2 includes NPN output driver 22; amplifier 24; resistors 26 and 28; buffer 30 which includes PMOS transistors 32 and 34, NPN transistor 36, and buffer currents Ibuf1 and Ibuf2; bias voltage Vbias; load capacitance CL; current IL; reference voltage Vref; supply voltage Vs; output voltage Vout; and ground gnd. The supply voltage Vs needs only to be a drain-to-source saturation voltage (Vds(sat)) above the base voltage of the output NPN transistor 22. Buffer 30 is essentially a PMOS source follower 34, with a localized feedback gain loop. Therefore, the actual output impedance of buffer 30 is the output impedance of transistor 34 (which is essentially the inverse of the transconductance of transistor 34) divided by the open-loop gain of the feedback loop. This low output impedance allows buffer 30 to drive larger capacitive loads. The topology of buffer 30 (the use of transistor 32) allows the buffer to drive the base current of NPN transistor 22 with low dropout characteristics.

Figure 3A:
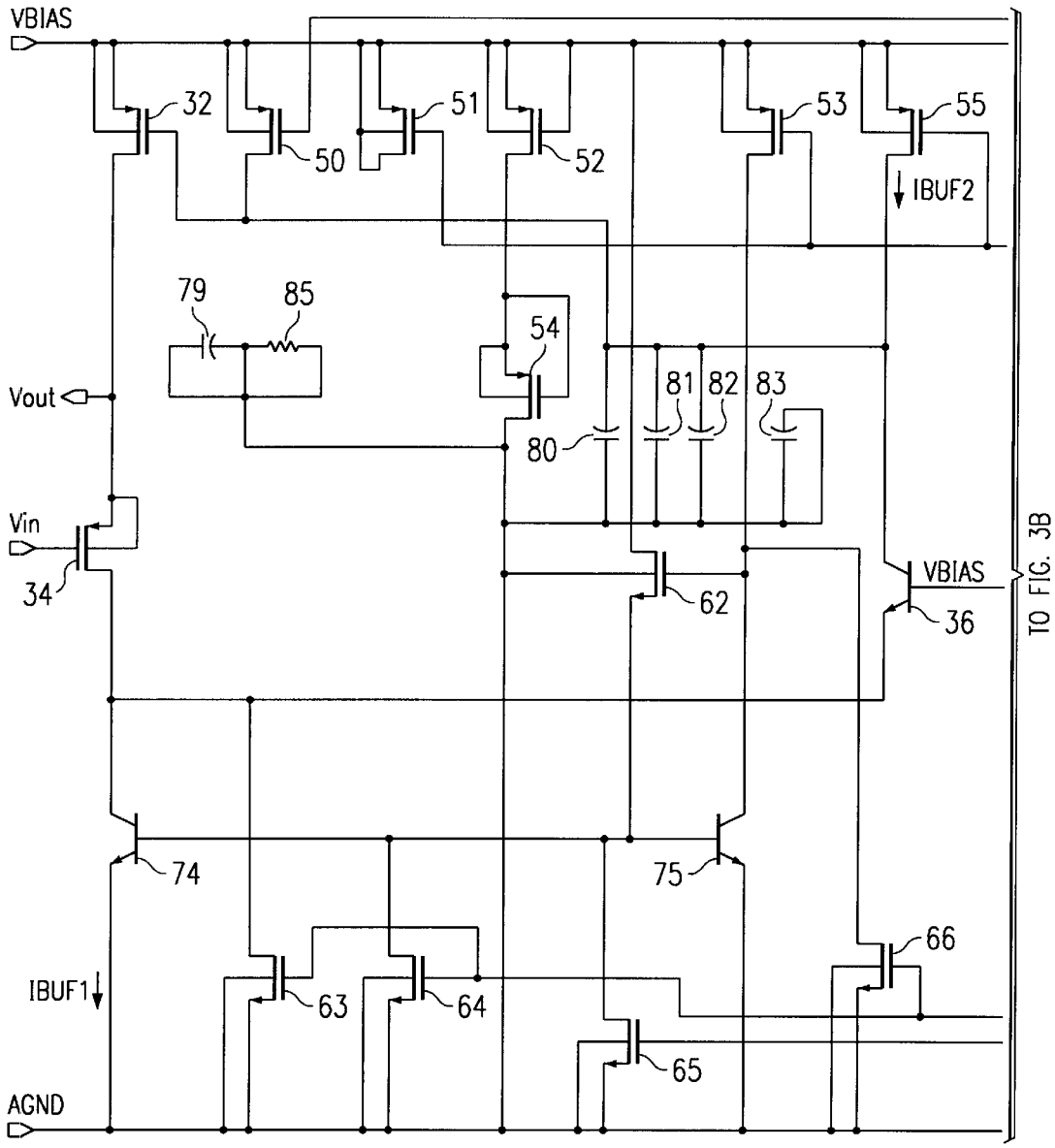
FIG. 3 is a detailed schematic circuit diagram of the circuit of FIG. 2.
Figure 3B:
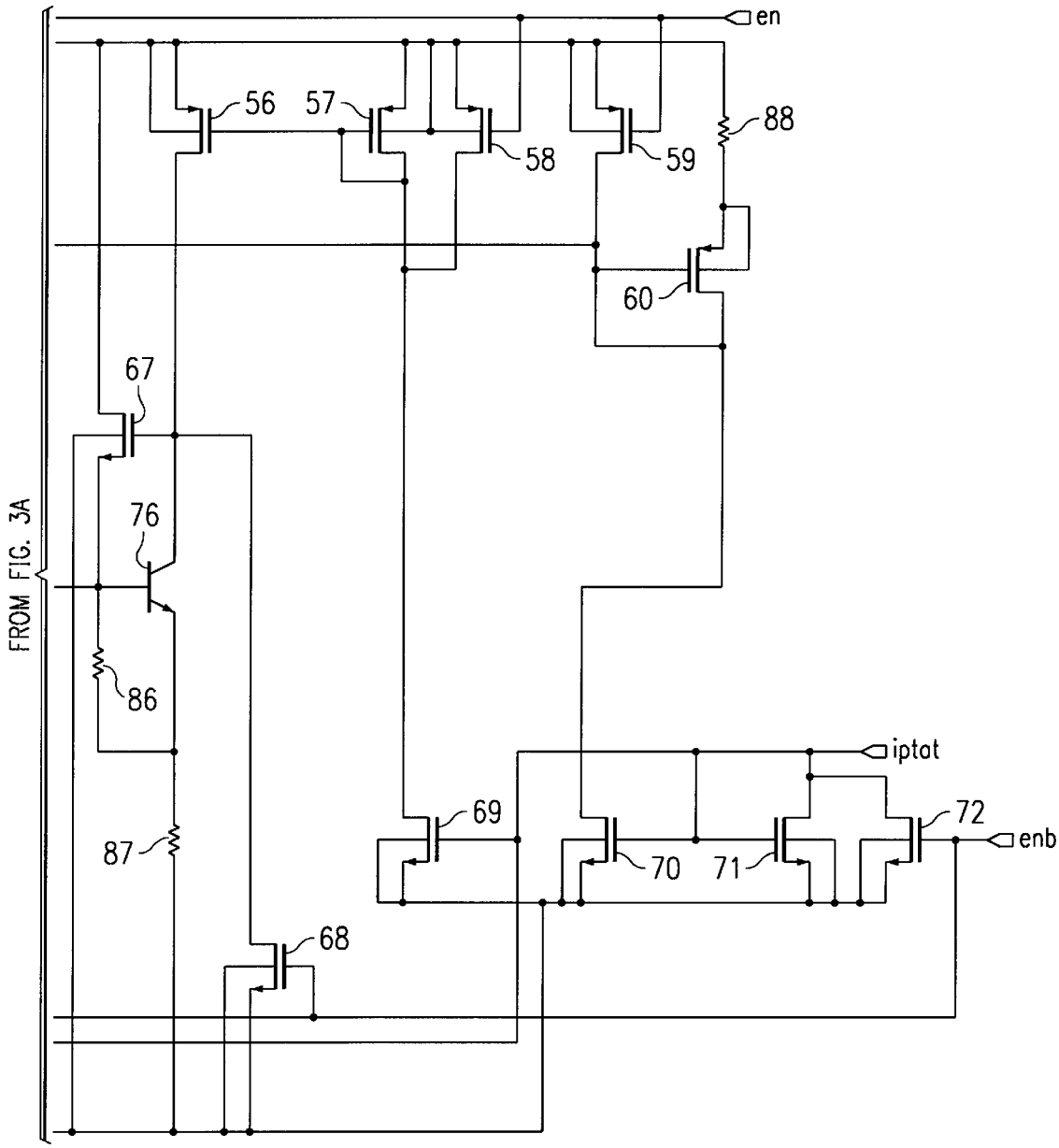

FIG. 3 shows a detailed schematic of buffer 30, including the biasing circuitry used for bias current sources Ibuf1 and Ibuf2 and bias voltage Vbias. The circuit of FIG. 3 includes PMOS transistors 32 and 34, NPN transistor 36, buffer currents Ibuf1 and Ibuf2, bias voltage Vbias, output voltage Vout, and ground gnd, as shown in FIG. 2, with additional circuitry for generating bias currents Ibuf1 and Ibuf2, and bias voltage Vbias. The additional circuitry includes PMOS transistors 50–60; NMOS transistors 62–72; NPN transistors 74–77; capacitors 79–83; resistors 85–88; input Vin; enable voltages en and enb; and current proportional to absolute temperature iptat.

Figure 4A:
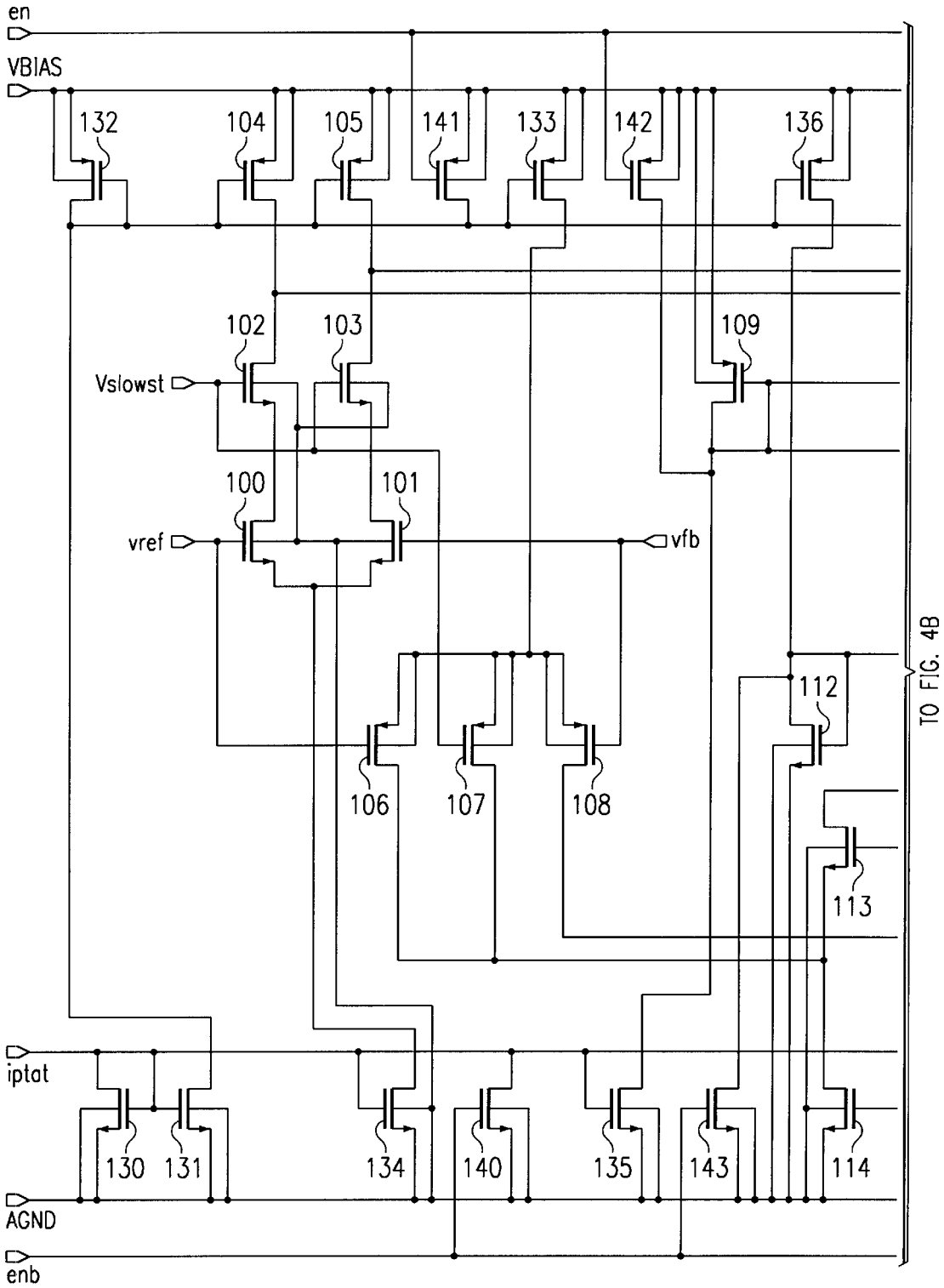
FIG. 4 is a schematic circuit diagram of an entire regulator using the circuit of FIG. 3.
Figure 4B:
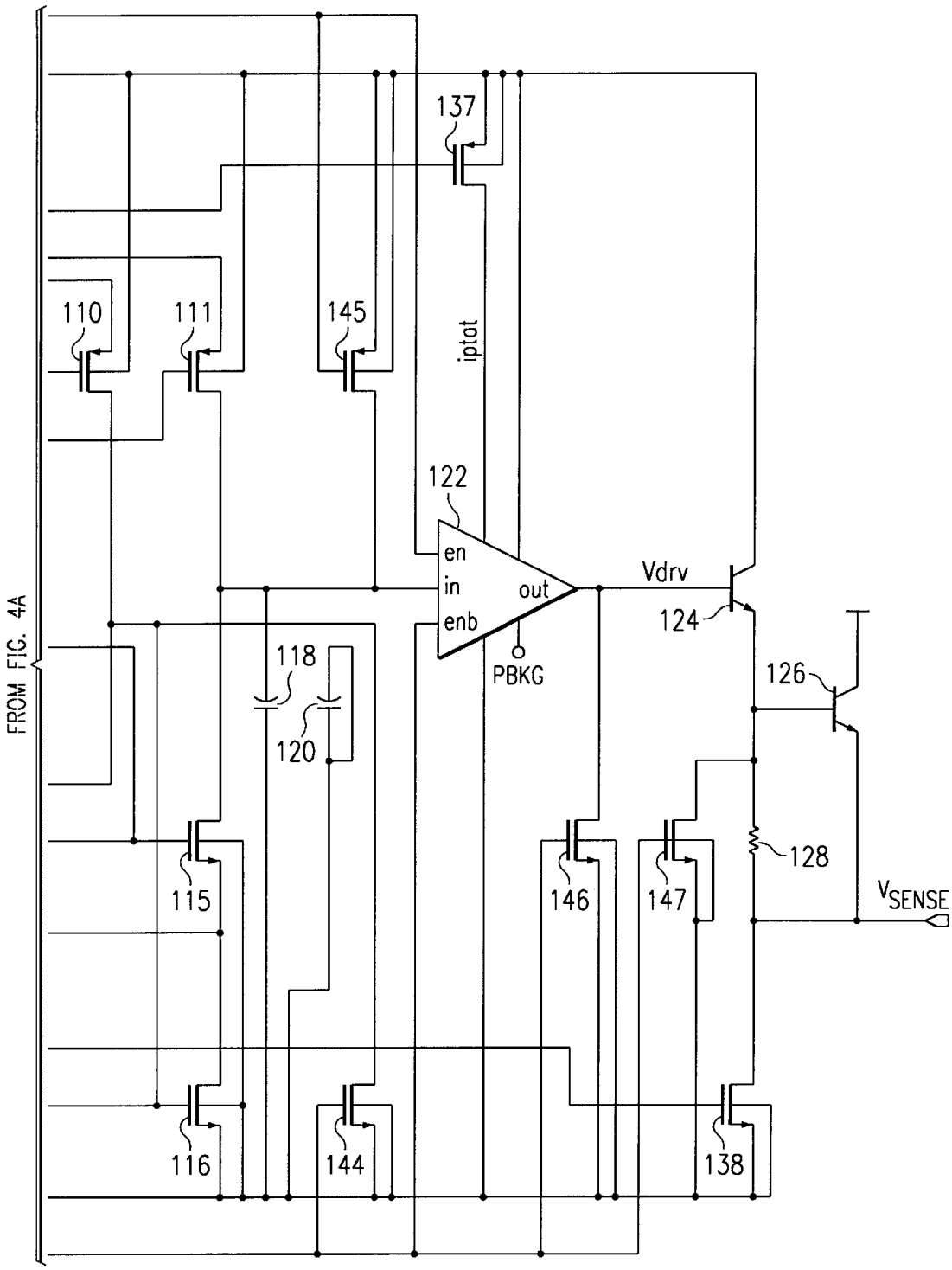

FIG. 4 shows the schematic of the entire regulator. The circuit of FIG. 4 includes a complimentary, folded cascode amplifier with slow start functions which includes transistors 100–116, capacitors 118 and 120, and input references Vref, Vslowst, and Vfb; buffer 122 described in FIG. 3; and a Darlington NPN pair which includes transistors 124 and 126, and resistor 128. It also contains circuitry for current biasing which includes transistors 130–138 and bias current input Iptat; as well as enable circuitry which includes transistors 140–147 and enable inputs en and enb; bias voltage Vbias; backgate bias PBKG; and output Vsense.

Figure 5:
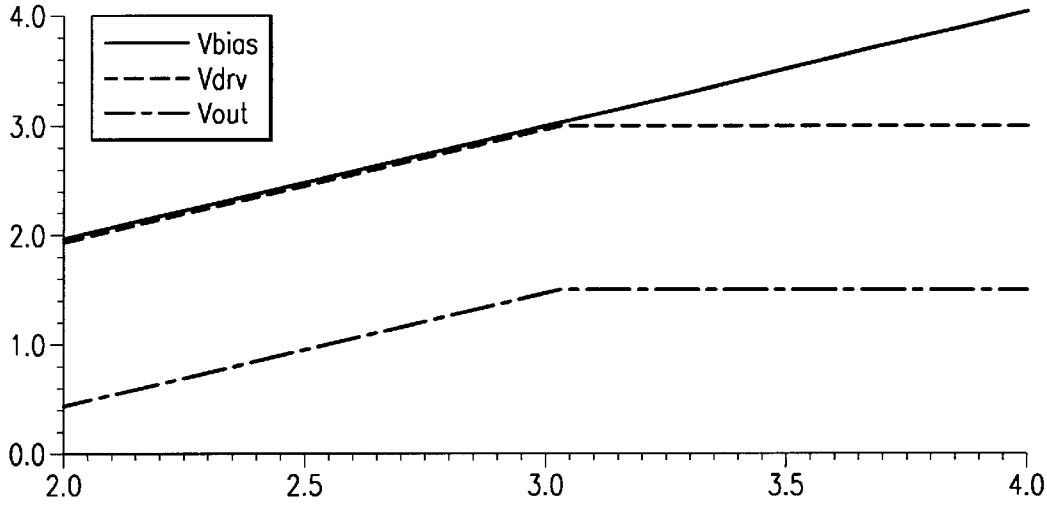
FIG. 5 is a plot of the line regulation for the circuit of FIG. 4.
Figure 6:
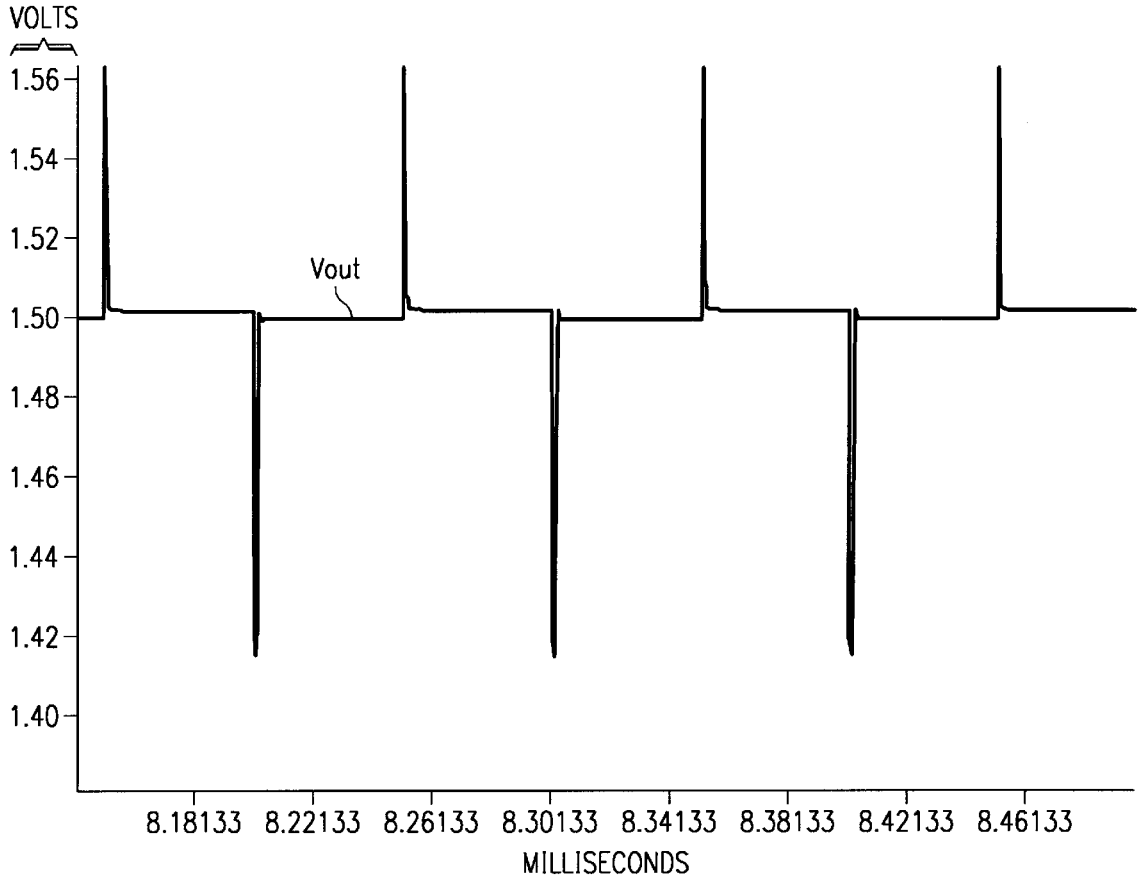
FIG. 6 is a plot of the transient response of the circuit of FIG. 4.

FIG. 5 shows the line regulation of the amplifier of FIG. 4 when regulating to 1.5 volts at sense. The difference between Vsense and Vdrv is the voltage drop across the output darlington NPN's 124 and 126. FIG. 6 shows the transient response of Vsense of the amplifier of FIG. 4 to a 0–2 amp current pulse with a 300 uF capacitor CL on the output. The capacitor has 40 milliohms of resistance.

The use of buffer 30 allows the regulator to drive the output NPN with low output impedance and low dropout voltage. It has lower output impedance and lower dropout voltage than a standard prior art source-follower, at the cost of only two transistors and one current source. Alternatively, it can achieve a desired output impedance with much less quiescent-current than a source-follower. It is a simple design that is compatible with Bipolar, CMOS, or BiCMOS processes.

While this invention has been described with reference to an illustrative embodiment, this description is not intended to be construed in a limiting sense. Various modifications of the illustrative embodiment, as well as other embodiments of the invention, will be apparent to persons skilled in the art upon reference to the description. It is therefore intended that the appended claims encompass any such modifications or embodiments.

What is claimed is:

1. A voltage regulator circuit comprising:

an output driver;

a source follower for controlling the output driver, wherein the source follower is a MOS transistor having a source coupled to a control node of the output driver and having a gate coupled to the amplifier;

a localized feedback gain loop coupled to the source follower, wherein the localized feedback gain loop comprises:

a first transistor coupled between the control node of the output driver and a common node;

a second transistor coupled between a control node of the first transistor and the MOS transistor;

a first current source coupled between the common node and the control node of the first transistor; and a second current source coupled to the MOS transistor; and an amplifier for controlling the source follower.

2. The circuit of claim 1 wherein the output driver is a bipolar transistor.

3. The circuit of claim 2 wherein the bipolar transistor is an NPN bipolar transistor.

4. The circuit of claim 1 wherein the MOS transistor is a PMOS transistor.

5. The circuit of claim 1 wherein the first transistor is a PMOS transistor and the second transistor is an NPN bipolar transistor.

6. The circuit of claim 1 further comprising a bias voltage coupled to a control node of the second transistor.

7. The circuit of claim 1 further comprising a resistor feedback coupled between the output driver and a first input of the amplifier.

8. The circuit of claim 7 wherein the feedback network comprises:

a first resistor coupled between the output driver and the first input of the amplifier; and a second resistor coupled between the first input of the amplifier and a ground node.

9. The circuit of claim 7 further comprising a reference voltage coupled to a second input of the amplifier.

10. A buffer circuit comprising:

a source follower coupled to an output node and having a control node coupled to an input node;

a first transistor coupled between a common node and the output node;

a second transistor coupled between the source follower and a control node of the first transistor;

a first current source coupled between the control node of the first transistor and the common node; and a second current source coupled to the source follower.

11. The circuit of claim 10 wherein the source follower is a MOS transistor.

12. The circuit of claim 11 wherein the MOS transistor is a PMOS transistor.

13. The circuit of claim 10 wherein the first transistor is a PMOS transistor.

14. The circuit of claim 10 wherein the second transistor is an NPN bipolar transistor.

* * * * *